US008562812B2

(12) United States Patent
Maurin-Perrier et al.

(10) Patent No.: US 8,562,812 B2
(45) Date of Patent: Oct. 22, 2013

(54) SULPHURATION METHOD OF FERROUS ALLOY PARTS IN AN AQUEOUS SOLUTION

(75) Inventors: Philippe Maurin-Perrier, Saint-Marcellin-En-Forez (FR); Herve Chavanne, Noalhat (FR); Smail Aaziz, Saint-Etienne (FR)

(73) Assignee: H.E.F., Andrezieux Boutheon (FR)

( * ) Notice: Subject to any disclaimer, the term of this patent is extended or adjusted under 35 U.S.C. 154(b) by 907 days.

(21) Appl. No.: 12/515,480

(22) PCT Filed: Nov. 16, 2007

(86) PCT No.: PCT/FR2007/001886
§ 371 (c)(1), (2), (4) Date: May 19, 2009

(87) PCT Pub. No.: WO2008/068421
PCT Pub. Date: Jun. 12, 2008

(65) Prior Publication Data

US 2010/0044234 A1 Feb. 25, 2010

(30) Foreign Application Priority Data

Nov. 24, 2006 (FR) ..... 06 55097

(51) Int. Cl.
*C25D 9/10* (2006.01)
*C25D 9/06* (2006.01)
*C25D 9/00* (2006.01)

(52) U.S. Cl.
USPC ..... 205/735; 205/687; 205/704; 205/724

(58) Field of Classification Search
USPC ..... 205/735
See application file for complete search history.

(56) References Cited

U.S. PATENT DOCUMENTS

| | | | | |
|---|---|---|---|---|
| 3,475,291 | A | 10/1969 | Caubet | |
| 3,770,595 | A * | 11/1973 | Cros et al. | 205/206 |
| 4,184,931 | A * | 1/1980 | Inoue | 205/341 |
| 4,256,548 | A * | 3/1981 | Barclay et al. | 205/243 |
| 4,615,777 | A * | 10/1986 | Miles et al. | 205/637 |
| 6,139,973 | A * | 10/2000 | Kawasaki et al. | 428/469 |
| 6,589,412 | B1 * | 7/2003 | Ogawa et al. | 205/112 |
| 7,172,794 | B2 | 2/2007 | Chomer et al. | |
| 2004/0000492 | A1 * | 1/2004 | Ogawa et al. | 205/320 |
| 2007/0125659 | A1 * | 6/2007 | Hecker Cartes | 205/341 |
| 2007/0137735 | A1 | 6/2007 | Maurin-Perrier et al. | |

FOREIGN PATENT DOCUMENTS

| | | |
|---|---|---|
| FR | 1136181 | 5/1957 |
| FR | 1406530 | 7/1965 |
| FR | 2050754 | 4/1971 |
| FR | 2 823 227 | 10/2002 |
| FR | 2 860 806 | 4/2005 |
| JP | 11302897 A * | 11/1999 |
| JP | 2002235193 A * | 8/2002 |
| SU | 931801 | 5/1982 |

OTHER PUBLICATIONS

English Translation of Japanese Patent Publication No. JP-2002235193-A.*
English Translation of Japanese Patent Publication No. JP-11302897-A.*
English Machine Translation of FR 2050754—Stephanois.*
Human Translation of JP 2002-235193—Hirai.*
J. Robert et al., "Surface Treatments in Concentrated Aqueous Baths At Very Low Temperatures", Entropie, vol. 10, No. 57, May 1974, XP008075613, pp. 27-31.
Ju Yi, "Electrolytic Sulphurizing in Room Temperature After Carbo-Nitriding", Heat Treat Met, No. 7, 1988, XP008075612, pp. 31-39.
E. Cosmacini et al., "A Study of the Influence of Low Temperature Sulphurization on the Behavior of Lubricants in Standard Extreme Pressure Test", vol. 73, 1981, XP002422543, pp. 1-8.
International Search Report dated Jun. 3, 2008, from corresponding PCT application.

* cited by examiner

*Primary Examiner* — Keith Hendricks
*Assistant Examiner* — Salil Jain
(74) *Attorney, Agent, or Firm* — Young & Thompson

(57) ABSTRACT

The invention relates to a superficial treatment method by electrolysis of ferrous surfaces to enhance friction or tread and seizing resistance features, wherein the surfaces provide the electrolysis anode, the electrolysis bath includes a sulphur species, primarily contains water and also contains a chloride salt and a nitrogen species in quantities which facilitates the sulphuration reaction of the surfaces.

21 Claims, No Drawings

SULPHURATION METHOD OF FERROUS ALLOY PARTS IN AN AQUEOUS SOLUTION

FIELD OF THE INVENTION

The invention relates to a process for the treatment of metal surfaces and more generally the surfaces of ferrous alloy parts.

BACKGROUND OF THE INVENTION

Such treatments are known to a person skilled in the art and are used in the design of mechanical elements, for example when parts have to rub against one another under severe load and pressure conditions. These treatments can be applied both in cases where the ferrous alloy parts are intended to be lubricated (with oil, with grease, and the like) and in cases where the parts are not intended to be lubricated.

Mention may be made, among the various known treatment processes, of processes for surface oxidation in baths of molten salts (mixtures of nitrates and nitrites) which make it possible to improve the corrosion resistance.

Phosphatization processes are also known which make it possible, by the creation of a surface layer of iron phosphate, to substantially improve the effects of the lubrication.

Sulfurization processes, that is to say processes for producing a layer of iron sulfide (FeS) at the surface of ferrous alloy parts with the aim of improving their properties of resistance to jamming, are also known. The parts treated by these sulfurization processes exhibit excellent resistance to rubbing, to wear and to jamming.

The invention relates more particularly to the latter type of treatment.

The sulfurization of steels and its effects on lubrication are known to a person skilled in the art and emerge, for example, from the teaching of patents FR 1 406 530, FR 2 050 754 and FR 2 823 227.

According to the teaching of these patents, the metal parts treated are immersed for 5 to 15 minutes in a bath of ionized molten salts at between 200 and 350° C. preferentially comprising potassium thiocyanate and cyanide ions, the ionization being obtained by an electrolysis, the treated part being positioned at the anode. The layer of FeS is obtained by modifying the surface layer of the ferrous alloy part. This electrolytic sulfurization in molten salts requires specific precautions in order to keep the bath in a stable condition during the passage of the current and necessitates that particular attention be paid to the recycling of the compounds used. Furthermore, this process requires a large amount of salts, which proves to be expensive.

Another solution emerges from the teaching of patent U.S. Pat. No. 6 139 973, which relates to a process which makes it possible to deposit iron sulfide by electrolysis of an aqueous solution comprising ferric ions and thiosulfate or sulfide ions at between 30 and 50° C. The treated part is this time positioned at the cathode. This process results in significant problems of adhesion of the layer of iron sulfide to the treated parts.

A sulfurization treatment by a purely chemical route, without recourse to an electrolysis, is taught in patent FR 2 860 806. The parts are immersed in an aqueous solution comprising sodium hydroxide at a concentration of between 400 and 1000 g/l, sodium thiosulfate and sodium sulfide, at a temperature of greater than 100° C. for approximately 15 minutes. The major disadvantage of this process is the natural carbonatation of the bath, which gradually renders it unusable. This inevitable deterioration imposes both economic and ecological constraints. In addition, the treatment times are lengthy, which is harmful.

SUMMARY OF THE INVENTION

The problem which the invention intends to solve is that of reducing the amount of toxic products generated by the process and of reducing the energy consumption necessitated by the latter, while retaining a high antijamming effect and good adhesion of the layer of iron sulfide to the treated parts.

In order to solve this problem, a process for the surface treatment by electrolysis of ferrous surfaces in order to improve their qualities of rubbing or of resistance to wear and to jamming has been designed and developed, during which process said surfaces form the anode of the electrolysis and the bath of the electrolysis comprises a sulfur-comprising entity, said bath comprises predominantly water and additionally comprises a chlorine-comprising salt and a nitrogen-comprising entity in amounts suitable for making possible or facilitating the sulfurization reaction of said surfaces.

The antijamming effect obtained is good and is highly reproducible. The layer of iron sulfide obtained adheres well to the surface. The amount of salts and other starting materials used is low. The production of toxic waste is limited and the consumption of energy required by the reaction is low. The process is thus an excellent compromise, combining effectiveness and savings.

DETAILED DESCRIPTION OF THE INVENTION

The bath can be an aqueous solution.

Preferably, the sulfur-comprising entity is a sulfide. It can be sodium monosulfide, potassium monosulfide or ammonium monosulfide. It can also be a thiosulfate, such as sodium thiosulfate, potassium thiosulfate or ammonium thiosulfate. It can also be a sulfite.

Preferably, the sulfide is introduced at a concentration equivalent to a concentration of sulfide ions of between 20 g/l and 90 g/l.

Preferably, the sulfide is sodium monosulfide, introduced at a concentration between 50 and 200 g/l.

Preferably, the chlorine-comprising salt is a chloride, for example sodium, potassium, lithium, ammonium, calcium or magnesium chloride. It can also be a hypochlorite, a chlorite, a chlorate or a perchlorate, equally, for example, of sodium, potassium, lithium, ammonium, calcium or magnesium.

Preferably, the chloride is introduced at a concentration equivalent to a concentration of chloride ions of between 15 and 200 g/l approximately.

Preferably, the chloride is sodium chloride, introduced at a concentration between 30 and 300 g/l.

Preferably, the content of nitrogen-comprising entity is between 100 ml/l and 300 ml/l approximately. The nitrogen-comprising entity can comprise one nitrogen or several nitrogens. It can, for example, be a base, optionally a weak base, indeed even a very weak base. It can also be a base which has been weakened, for example by a substituent, or, conversely, a base which has been strengthened. It can be an organic entity.

Preferably, the nitrogen-comprising entity is an amine, for example a monosubstituted or polysubstituted amine. It is, for example, triethanolamine, methylamine, phenylamine, diethylamine, diphenylamine or cyclohexylamine, for example. The amine can be introduced in the form of an amino acid, such as alanine, glutamic acid or proline, for example. The nitrogen-comprising entity can also be an amide, an amidine, a guanidine, a hydrazine or a hydrazone. It can also be a mixture of these compounds. The nitrogen-comprising entity can also carry one or more oxygen atoms or one or more alcohol functional groups at a chosen distance from the nitrogen or at chosen distances from the nitrogen atom or nitrogen atoms. It can also carry other atoms or other functional groups.

Preferably, triethanolamine is used and the amount of triethanolamine introduced is between 100 ml/l and 300 ml/l approximately. The mechanism of action of this molecule has not been clarified and the respective roles of each of the characteristics of this molecule are not known.

If appropriate, the content of nitrogen-comprising entity is evaluated as triethanolamine equivalent according to conventional methods, in which case the preferred content of nitrogen-comprising entity is equivalent to a content of triethanolamine of between 100 ml/l and 300 ml/l.

Preferably, the operating temperature of the bath is less than 70° C. It can be ambient temperature, which reduces the energy consumption.

Preferably, the duration of the treatment by electrolysis is less than 1 hour or, in some cases, less than 10 minutes, indeed even less than one minute.

Preferably, the electrolysis is carried out using a continuous current.

According to one characteristic, the electrolysis is carried out using a pulsating current. The latter can be applied in the form of a slot-like signal or in another form.

Preferably, the pulsating current has a frequency of less than 500 kHz (that is to say, a period of greater than 2 μs).

The duration of the pulses is less than the period of the signal and, according to one characteristic, it is less than 50 ms.

Preferably, the mean current density is between 3 and 15 $A/dm^2$ and is, for example, 8 $A/dm^2$ approximately or 5 $A/dm^2$.

Preferably, the cathode is made of a conducting material which is inert in the solution. Preferably, it is made of stainless steel.

Finally, the invention also relates to the parts, the surface of which is treated according to the process according to the invention.

According to a preferred embodiment, the parts to be treated are positioned in an electrolysis bath at the anode. A current density is applied between the parts and a cathode. The duration of the treatment is between a few seconds and 10 minutes, indeed even 20 minutes, 30 minutes or more, according to the geometry and the surface area of the parts to be treated. The treatment is typically carried out at a temperature of less than 70° C.

The resistance to jamming resulting from the treatment process according to the invention is evaluated according to the test on the Faville Levally machine according to standard ASTM-D-2170.

In a way known to a person skilled in the art, this test consists in treating a case-hardened, quenched and ground 16NC6 steel cylindrical test specimen with a diameter of 6.35 mm and a height of 50 mm. The test specimen is clamped between two jaws cut in a right-angled V to which a load is applied which increases linearly as a function of time. The test is halted when jamming or creep of the test specimen occurs. This test is characterized by a quantity referred to as the Faville grade, which is the integral of the load applied with respect to time, this grade being expressed in daN.s.

Reference is made below to the examples, which are given by way of indication without any limitation and which show the results obtained with the characteristics of the process according to the invention, in comparison with treatments according to the prior state of the art.

It is apparent that, when the test specimen is treated according to the process in accordance with the invention, the test specimen creeps and does not jam and that its Faville grade is generally greater than 12 000 daN.s.

EXAMPLE 1

According to this example, the Faville grade of case-hardened quenched 16NC6 steel test specimens is compared in the case of an untreated test specimen (1), of a phosphatized test specimen (2) and of a test specimen in accordance with the process of the invention (3).

The test specimen according to the invention is quenched in an aqueous solution and maintained at the anode. The cathode is made of stainless steel. At the preparation of the bath, the aqueous solution comprises 100 g/l of sodium monosulfide, 50 g/l of sodium chloride and 200 ml/l of triethanolamine.

According to a first alternative form, the treatment is carried out at ambient temperature (20° C.) for 10 seconds, the current is continuous and the current density applied is 8 $A/dm^2$.

According to a second alternative form, the treatment is carried out still at ambient temperature but for 5 minutes, with a pulsating current at a frequency of 25 Hz (that is to say, with a period of 40 ms), the duration of the pulses being 10 ms and the period-averaged current density being 4 $A/dm^2$.

Reference is made to the table below:

| | 1 Untreated test specimen | 2 Phosphatized test specimen (iron/manganese phosphatization) | 3 Test specimen sulfurized according to the invention (1st alternative form) | 4 Test specimen sulfurized according to the invention (2nd alternative form) |
|---|---|---|---|---|
| Faville grade (daN · s) | 5000 | 5500 | 15 000 | 15 000 |
| Halting of the test | Jamming | Jamming | Creep | Creep |

It emerges from this test that the test specimens 1 and 2 have no antijamming property whereas the test specimens 3 and 4, in accordance with the invention, have good antijamming properties.

EXAMPLE 2

In this example, a comparison is made between the Faville grades of case-hardened quenched 16NC6 steel test specimens sulfurized by the process in accordance with the invention (1) and by the electrolytic process in a medium formed of baths of molten salts, as emerges from the teaching of patent FR 2 050 754. Reference is made to the table below:

| | 1 Test specimen sulfurized according to the invention (1st alternative form) | 2 Test specimen sulfurized according to the invention (2nd alternative form) | 3 Test specimen sulfurized in accordance with FR 2 050 754 |
|---|---|---|---|
| Faville grade (daN · s) | 15 000 | 15 000 | 15 000 |
| Halting of the test | Creep | Creep | Creep |

The test specimen according to the invention is immersed in a bath of an aqueous solution and maintained at the anode. The cathode is made of stainless steel. At the preparation of the bath, the aqueous solution comprises 100 g/l of sodium monosulfide, 50 g/l of sodium chloride and 200 ml/l of triethanolamine.

According to a first alternative form, the treatment is carried out at ambient temperature (20° C.) for 10 minutes with a pulsating current at a frequency of 200 kHz (that is to say, with a period of 5 μs), the duration of the pulses being 2 μs and the period-averaged current density being 4 A/dm$^2$.

According to a second alternative form, the treatment is carried out still at ambient temperature but for 10 minutes, with a continuous current and a current density of 5 A/dm$^2$.

It emerges from these tests that the solutions 1, 2 and 3 have entirely similar antijamming properties.

A person skilled in the art will adjust the duration of the treatment, which can be between a few seconds and 30 minutes, indeed even more, being, for example, of an order of magnitude of 10 minutes, according to the geometry and the surface area of the parts to be treated. He will also adjust the temperature, which can be ambient temperature or a temperature of less than 70° C. or more. He will also adjust the current density.

The advantages clearly emerge from the description; in particular, the following are emphasized and restated:

respect for the environment, control, with great accuracy and high reproducibility, of the composition, of the adhesion and of the continuity of the surface layers, treatment at ambient temperature, making it possible to reduce the energy consumption, short or very short treatment time, making it possible to produce shorter operating cycles.

The invention claimed is:

1. A process for treating the surface of a ferrous alloy part, comprising:

providing an aqueous electrolysis bath solution consisting essentially of:

water, a sulfur compound selected from the group consisting of sulfide, thiosulfate and sulphite, a chlorine-comprising salt, and a liquid, alkaline amine;

immersing said ferrous surface in the electrolysis bath solution; and conducting electrolysis while maintaining said ferrous surface as an anode during the electrolysis.

2. The process according to claim 1, wherein the sulfur compound is a sulfide.

3. The process according to claim 2, wherein the sulfide is present in the electrolysis bath at a concentration equivalent to a concentration of sulfide ions of between 20 g/l and 90 g/l.

4. The process according to claim 2, wherein the sulfide is sodium monosulfide.

5. The process according to claim 1, wherein the chlorine-comprising salt is a chloride.

6. The process according to claim 5, wherein the chloride is present in the electrolysis bath at a concentration equivalent to a concentration of chloride ions of between 15 g/l and 200 g/l.

7. The process according to claim 5, wherein the chloride is sodium chloride.

8. The process according to claim 1, wherein the amine is present in the electrolysis bath at a concentration between 100 ml/l and 300 ml/l.

9. The process to claim 1, wherein the amine is triethanolamine.

10. The process according to claim 1, wherein the electrolysis is conducted at a temperature of less than 70° C.

11. The process according to claim 1, wherein the electrolysis is conducted at 20 degrees Celsius.

12. The process according to claim 1, wherein the electrolysis is conducted for a time of less than 1 hour.

13. The process according to claim 1, wherein the electrolysis is conducted using a continuous current.

14. The process according to claim 1, wherein the electrolysis is conducted using a pulsating current.

15. The process according to claim 14, wherein the pulsating current has a frequency of less than 500 kHz.

16. The process according to claim 14, wherein the pulsating current has a pulse duration of less than 50 milliseconds.

17. The process according to claim 1, wherein the electrolysis is carried out using a mean current density between 3 A/dm$^2$ and 15 A/dm$^2$.

18. The process according to claim 1, wherein the electrolysis uses a cathode comprising a conducting material that is inert in the electrolysis bath.

19. The process according to claim 18, wherein the cathode comprises stainless steel.

20. The process according to claim 1, wherein the amine is selected from the group consisting of: triethanolamine, methylamine, phenylamine, diphenylaminediethylamine, cyclohexylamine and mixtures thereof.

21. The process according to claim 1, wherein the electrolysis bath consists essentially of water, sodium monosulfide, sodium chloride and triethanolamine.

* * * * *

UNITED STATES PATENT AND TRADEMARK OFFICE

CERTIFICATE OF CORRECTION

PATENT NO. : 8,562,812 B2
APPLICATION NO. : 12/515480
DATED : October 22, 2013
INVENTOR(S) : Maurin-Perrier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1026 days.

Signed and Sealed this
Fifteenth Day of September, 2015

Michelle K. Lee

Michelle K. Lee
*Director of the United States Patent and Trademark Office*